US005666689A

United States Patent [19]

Andersen

[11] Patent Number: 5,666,689

[45] Date of Patent: Sep. 16, 1997

[54] FLOOR CLEANING MACHINE

[75] Inventor: Ole Nygaard Andersen, Horsens, Denmark

[73] Assignee: Cleamatool A/S, Horsens, Denmark

[21] Appl. No.: 302,869

[22] PCT Filed: Mar. 18, 1993

[86] PCT No.: PCT/DK93/00097

§ 371 Date: Sep. 19, 1994

§ 102(e) Date: Sep. 19, 1994

[87] PCT Pub. No.: WO93/18699

PCT Pub. Date: Sep. 30, 1993

[30] Foreign Application Priority Data

Mar. 18, 1992 [DK] Denmark ..... 361/92

[51] Int. Cl.[6] ..... A47L 5/30

[52] U.S. Cl. ..... 15/384; 15/48; 15/349

[58] Field of Search ..... 15/384, 349, 48

[56] References Cited

U.S. PATENT DOCUMENTS

| | | | |
|---|---|---|---|
| 1,268,963 | 6/1918 | Gray | 15/384 X |
| 1,759,881 | 5/1930 | Bentley | 15/384 |
| 4,426,751 | 1/1984 | Nordeen | 15/384 |
| 5,077,862 | 1/1992 | Rench | 15/384 |
| 5,086,539 | 2/1992 | Rench | 15/384 |

FOREIGN PATENT DOCUMENTS

| | | | |
|---|---|---|---|
| 1931692 | 1/1970 | Germany | 15/384 |
| 97369 | 11/1939 | Sweden | 15/384 |

*Primary Examiner*—Chris K. Moore

*Attorney, Agent, or Firm*—Antonelli, Terry, Stout & Kraus, LLP.

[57] ABSTRACT

A cleaning machine, especially for professional cleaning, comprises two parallel and cylindrical brushes driven reversedly about a horizontal axis, the brushes being placed so closely together that the ends of the brushes in the plane defined by the rotational axes of the brushes almost join, touch one another or just overlap. Above said plane one or more sweepers in the form of bars, pipes, stretched wires or the like are arranged in the longitudinal direction of the brushes and extend into the course of rotation of the brush ends. There is a shield above the brushes for collecting the dirt that is thrown off them when meeting the sweepers. At the exterior of the brushes the shield ends in collecting receivers from which the collected dirt may pass to a collecting tank. This design proves capable of performing a simultaneous sweeping and washing of a floor. At the same time the construction is sufficiently compact to accommodate a polishing unit such that a simultaneous polishing of the floor is possible.

13 Claims, 2 Drawing Sheets

FLOOR CLEANING MACHINE

BACKGROUND OF THE INVENTION

1. Field of the Invention

The present invention relates to a cleaning machine, especially for professional cleaning and having two parallel and cylindrical brushes driven in reverse directions about a horizontal axis.

2. Description of the Prior Art

In commercial cleaning of large floor spaces as e.g. in super markets, sales rooms, schools, sports centres, nursing homes, hospitals and industrial premises having a solid flooring such as linoleum, marble tiles, wood, an initial mopping is carried out to remove loose dirt from the floor. This is typically carried out manually by using mops. Then a mechanical washing of the floor is carried out and if required a polishing of the floor can finish the job. This is also performed mechanically, but the polishing cannot begin until the floor has dried after washing. Such a cleaning demands three individual workings of the floor at the same time waiting for the floor to dry before the polishing can be initiated.

The type of floor washers which are most frequently used are based on rotating brush roundels, typically two or three. The cleaning agent is dispensed in the center of the roundels and in some cases at the front. After the roundels there is a suction foot consisting of two closely set rubber lips from which surplus water left after the roundels is sucked up into a collecting tank. The floor is left sufficiently dry for it to be walked on, but not sufficiently dry to be polished immediately. Certain large power driven models of floor washers have a rotating cylindrical horizontal brush intended to sweep the floor in front of the roundels. The brush, however, sweeps the dirt forwardly into a funnel situated in front and raised above floor level, which is not particularly effective. This type of floor washer is also unable to function when close to walls or racks.

Another type of floor washer that has come on the market comprises a rotating, cylindrical, horizontal brush at either side of a collecting tank. A vertical rubber belt is placed between the brushes and the tank. The brushes sweep the dirty detergent towards the rubber belts, it is fed upwardly and is scraped off at the upper edge of the collecting tank and falls down. The washer has the advantage over the aforementioned type that it can come closer to walls and racks and that dirt that has not been collected at one brush can be collected by the reversed rotation of the other one. Despite its virtues this floor washer, too, is only capable of performing a washing of the floor.

SUMMARY OF THE INVENTION

The present invention introduces a completely different and new principle rendering it possible to construct a cleaning machine such that it can sweep, wash and polish the floor simultaneously. According to the invention the cleaning machine comprises at least two parallel and cylindrical brushes driven in reverse direction bout a horizontal axis which are placed so closely together that the ends of the brushes in the plane defined by the rotational axes of the brushes almost join, touch one another or just overlap, and that above this plane at least one sweeper in the form of bars, pipes, stretched wires or the like are arranged in the longitudinal direction of the brushes and which are extending into the course of rotation of the brush ends and above the brushes there is a shield for collecting the dirt that is thrown off these when meeting the sweepers, and where the shield at the end of the brushes ends in collecting conduits running in the longitudinal direction to the brushes, wherefrom the collected dirt may pass to a collecting tank.

With the invention a single set of brushes can perform a sweeping and a washing of the floor and leave it sufficiently dry to be walked on. By the close placing of the brushes a comparatively heavy suction effect arises in the wedge area facing the floor between the two closely set brushes sucking up the dirt which is transported on along, between and up onto the upper sides of the brushes. When the brushes meet the sweepers they are bent backwardly and the instant they leave the sweepers the dirt is thrown out onto the lower side of the shield and respectively falls or runs down into the collecting conduits. The best effect so far has been noted in segment brushes, i.e. brushes where the individual tufts are placed in rows and of a water-repellent material such as polypropylene. Preferably two sweepers per brush are arranged, one before the summit and one after the summit. With this combination the brushes are completely clean and dry before they again come into contact with the floor and the cleaning agent. The sweepers are either bars or pipes placed axially parallel to the brushes, but stretched wires could be used. The cross sections of the sweepers are in fact of secondary importance as long as they do not have sharp edges that can break or cut the tips of the brushes. The extension range of the sweepers into the course of the brush ends can be adjusted for achieving the maximum effect and compensation for wear of the brushes. This construction has the further advantage that the energy consumption is comparatively low which is of special importance in larger power driven machines running on batteries.

Naturally, the cleaning machine according to the invention can be configured into different embodiments ranging from a small manually operated machine for small jobs to a larger power-driven machines having several pairs of brushes placed next to one another. For floors that are particularly difficult to clean even further pairs of brushes may be placed after one another where the first set might exclusively perform a sweeping function.

For carrying out a subsequent polishing the machine may be provided with a usual polishing unit placed after the brush section. Between the brush section and the polishing unit a suction opening may be inserted for an extra drying of the floor prior to the polishing and an air-dryer may also be provided, preferably using the air from suction devices, which air in itself is slightly hot. Incorporating a polishing unit into the machine is rendered possible by its otherwise compact shape.

BRIEF DESCRIPTION OF THE DRAWINGS

The invention shall be described in further detail in the following with reference to the attached drawing, in which.

DESCRIPTION OF THE PREFERRED EMBODIMENTS

The basic principle of the brush section, which is an important part of the cleaning machine, is illustrated purely schematically and comprises two cylindrical brushes 2 driven respectively in reverse direction. Above the brushes is placed a shield 4 which at either side of these ends in a collecting conduit 6 for the dirt and the dust which is passed into a collection tank. Extending into the course of the brush ends are arranged two sweepers in the form of transverse round bars 8, two to each brush. One sweeper is placed before the top of the brush and the other after the top such that dirt and dust partly are thrown towards the shield and partly directly down into the collecting conduits.

Figure 1:
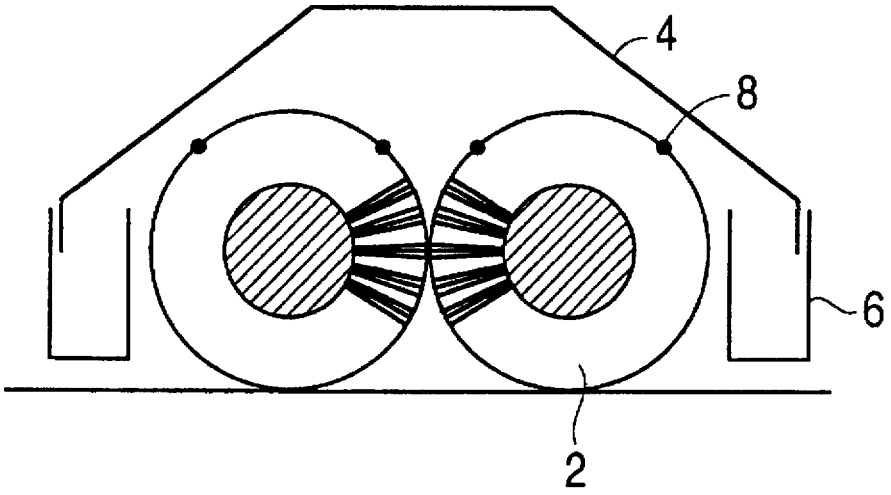
FIG. 1 illustrates the basic principle of the machine according to the invention in the form of a cross-section through the brush section.
Figure 2:
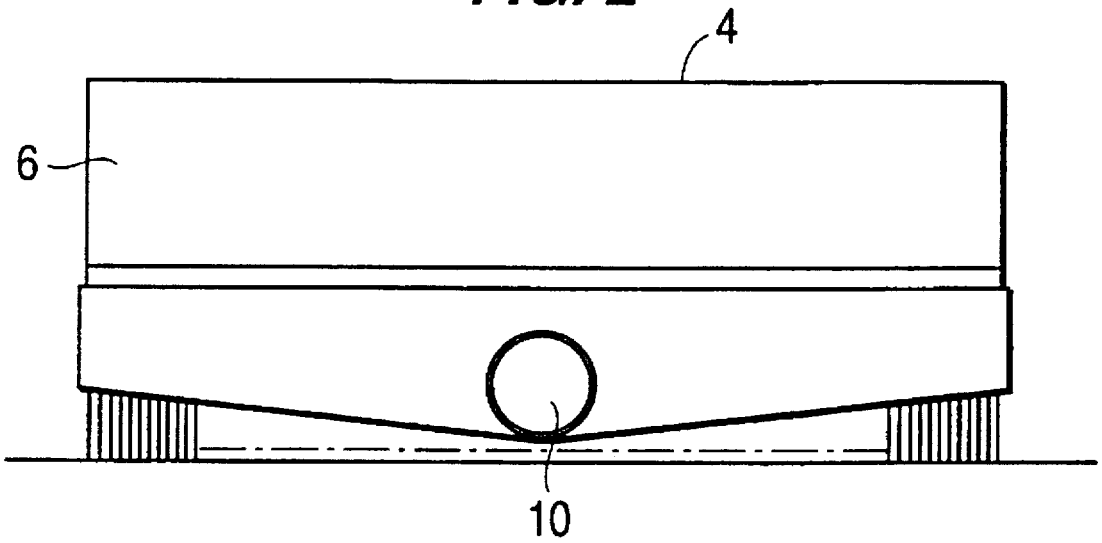
FIG. 2 illustrates a section of the invention in a direct view as seen from the front or the rear.

The dirt can be passed along from the collecting conduit 6 in a variety of ways; one method is by designing the conduit with a slanting bottom facing a suction inlet 10 as indicated in FIG. 2 of the drawing, illustrating the machine as seen in its forward direction, whereby the airflow, which from the brushes is sent underneath the shield, is directed down along the bottom towards the suction inlet moving the collected dirt along, just like water which runs towards the suction inlet by itself.

The illustrated brush section is the basic element of the invention and can form a basis for substantiating the invention from a simple manually operated apparatus to a larger power driven cleaning machine as illustrated in the following as an example.

Figure 3:
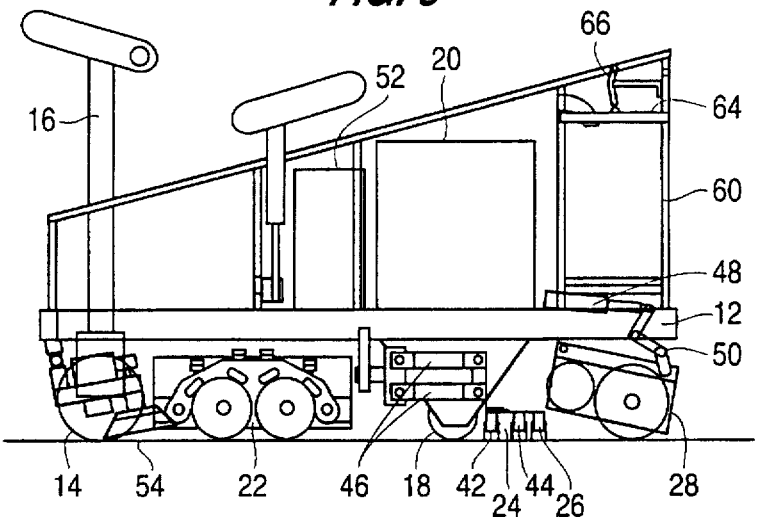
FIG. 3 is a schematic longitudinal section of a cleaning machine according to the invention.
Figure 4:
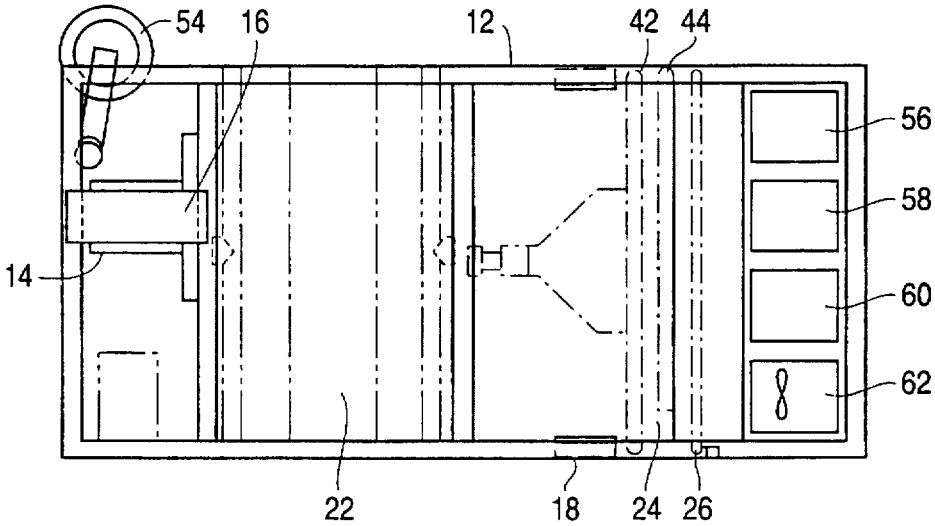
FIG. 4 is also a schematic outline of the machine.
Figure 5:
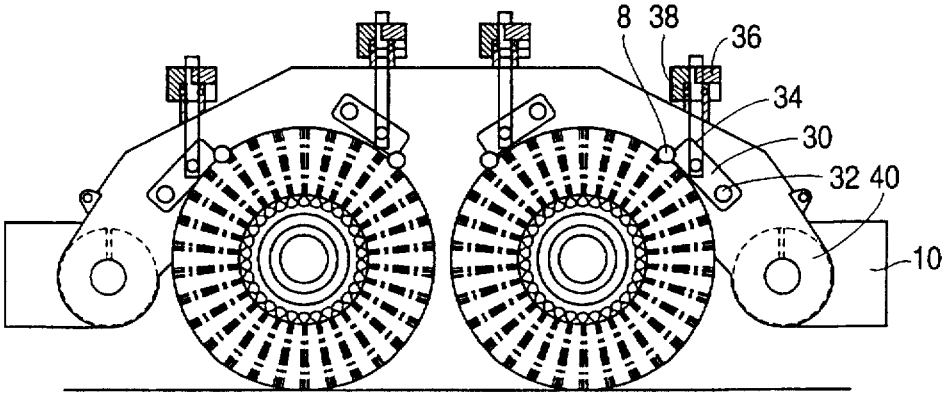
FIG. 5 is an enlarged view of a cross-section of the brush section of the machine.

A larger power driven cleaning machine is shown in FIGS. 3 and 4 of the drawing. The machine, which is three-wheeled, is constructed on a chassis frame 12 and is power operated. The front wheel 14 is a steering and driving wheel and is operated by a lever 16, into which various function keys and operating levers have been fitted. The driving wheel is of the same type as those used in pallet lifting trucks, i.e. a solid rubber wheel driven directly by an electric motor. The two rear wheels 18 are placed at the sides below a battery section 20.

Viewed from the front of the machine, when a brush section 22 is mounted as previously described, a suction opening 24 is followed by a blower 26 and last a polishing section 28. The brush section is mounted in an intermediate frame which again by a spring at each corner is mounted in the frame such that the brush section automatically follows the unevenness of the floor. The pressure of the brush section against the floor can be adjusted by a hydraulic cylinder mounted in the chassis and fastened to the center of the brush section. Water is used as a hydraulic liquid so that possible leakage does not leave stains on the floor. Even a minor leakage of hydraulic oil would leave spots and stripes on the floor. The brush section is in principle constructed in the same manner as above. The entry of the sweepers 8 into the course of the brushes 2 can be adjusted by an adjusting mechanism. The sweepers 8 are fastened at the end of a link 30 which at its other end is rotatably mounted at pivot 32 in the ends of the section. The link is further attached to a bar 34, the threaded end of which extends up onto the upper side of the section where adjustment nuts 36 with a locking screw 38 is situated. By turning of the adjustment nuts 36 the sweepers can be brought to interact more or less with the ends of the brushes 2. The sweepers can be locked in the desired position by the locking screws. To lead the dirt to the central exhaust 10 a brush 40 is placed in the conduits 6 with the brushes being placed in a right-hand helix in one half and in a left-hand helix in the other half. The brush is driven in such a manner that the dirt from the ends of the conduits is fed to the exhaust. The conduits are here straight having a circular cross-section or rather a semicircular cross-section. The two main brushes 2 and the conduit brushes 40 are driven by a common electric motor via a belt drive, or alternatively a gear.

The suction opening 24 consists of two pieces, a fixed part 42 and a sideways displaceable part 44 engaging the walls like vertical boundaries of a room. The sideways displaceable part 44 is mounted in a slide rail, and is spring-loaded to its extended position which is limited by a fender rail at the side of the machine. The rail is by its front pivotally fastened to the machine and the maximum movement is determined by a stop, in the hinge. When the machine moves up to a wall, the fender rail will cause the suction opening to retract and when the obstruction has been passed the suction opening returns to its extended position due to the spring loading.

The brush section as well as the suction opening are connected to a suction apparatus. In order to avoid an out-of-balance suction, each side of the brush section has an associated suction apparatus, and likewise is the suction opening is connected to an independent suction apparatus. The filtered exhaust air from the suction apparatuses is fed to the blower 26 for further drying of the floor. The suction opening 24 and the blower 26 are as a unit mounted in the chassis frame via parallel motion bars 46, such that these also are moving along the floor surface.

The polishing unit 28 is constructed on a frame which at its front is pivotally mounted in the chassis. By an electric actuator 48 fastened to the chassis and to the opposite side of the frame the polishing unit may be lowered into engaging the floor surface. The connection between the actuator and the polishing unit is a linkage 50 where one link is rotatably mounted in the chassis.

From a clean water tank 52 water is sprayed onto the floor via a nozzle arrangement placed in front of the brush section 22. In order to sweep up to walls, pillars, racks and similar vertical limitations of the room the machine is provided with a side brush 54 at its front. Otherwise the floor is swept and washed by the brush section where the dirt and the water from the conduits are fed to each their waste container 56, 58 at the rear of the machine. Any surplus water is sucked up by the suction opening 24 and is fed to a used water tank 60. The three tanks are placed at the rear of the machine together with the suction apparatuses that have been integrated into a unit 62. The tanks are detachable with lids 64 having incorporated edge lining and where the lid by a toggle link 66 may be squeezed down into tightening engagement with the tanks and retention of these. The three separate tanks 56, 58, 60 are no larger than can be lifted by one man out of the machine for emptying.

The battery section 20 is enclosed inside a glass fiber box and stands at a roller path fastened in the chassis such that the section as a whole may be rolled sideways out of the machine and e.g. across to a truck. The battery section is thus quickly replaced by another fully charged section allowing an optimum utilization of the machine. The machine may be brought from place to place on an especially designed trailer.

It will be seen that the machine distinguishes itself by performing finishing of cleaning of a floor in one run, i.e. sweeping, washing, drying and polishing. The machine cleans right up to walls, pillars, racks and similar vertical limitations of the room. If, for example, only a sweeping and a washing of the floor is required, the polishing section can be disconnected by raising it.

I claim:

1. A machine for cleaning floors comprising:

a pair of driven, counterrotating cylindrical brushes having bristles with bristle ends for engaging the floor and picking up dirt therefrom, the brushes being rotated such that the bristles on both brushes are moved upwardly through an area between the brushes and away from each other over an upper half of the brushes;

a housing for said pair of driven counterrotating cylindrical brushes comprising side plates for rotatably supporting shafts respectively attached to the cylindrical brushes and a top shield for covering the brushes; and wherein each brush has at least one fixed sweeper held by said housing and extending parallel to a longitudinal axis of the brush and located at least partly inside an outer periphery of the bristle ends thereof at a place along the upper half of the brush, each sweeper serving to locally and temporarily hold back the bristle ends and cause the bristle ends to flick forwardly in a direction of rotation of the brush when the bristle ends leave contact with the sweeper to cause floor dirt collected by the bristle ends to be thrown off outwardly and forwardly relative to rotary motion of the brush; and said top shield guides the dirt thrown off the bristle ends further in a direction of rotation of the brushes towards dust collecting receivers arranged at respective opposite ends of the top shield.

2. A machine in accordance with claim 1 wherein:

a first sweeper and a second sweeper are respectively positioned before and after a top of each of the pair of driven counterrotating cylindrical brushes.

3. A machine in accordance with claim 2 wherein:

a cross-sectional dimension of each of the sweepers is smaller than a diameter of each of the at least two driven cylindrical brushes.

4. A floor cleaning machine in accordance with claim 3 further comprising:

a plurality of adjustment devices, each adjustment device adjusting an amount of engagement of a different sweeper with one of the pair of driven counterrotating cylindrical brushes.

5. A machine in accordance with claim 3 wherein:

the machine has a front and a rear end; and a polishing unit is disposed at the rear end and behind the pair of driven counterrotating cylindrical brushes.

6. A floor cleaning machine in accordance with claim 2 further comprising:

a plurality of adjustment devices, each adjustment device adjusting an amount of engagement of a different sweeper with one of the pair of driven counterrotating cylindrical brushes.

7. A machine in accordance with claim 2 wherein:

the machine has a front and a rear end; and a polishing unit is disposed at the rear end and behind the pair of driven counterrotating cylindrical brushes.

8. A machine in accordance with claim 1 wherein:

a cross-sectional dimension of each of the sweepers is smaller than a diameter of each of the pair of driven cylindrical brushes.

9. A floor cleaning machine in accordance with claim 8 further comprising:

a plurality of adjustment devices, each adjustment device adjusting an amount of engagement of a different sweeper with one of the pair of driven counterrotating cylindrical brushes.

10. A machine in accordance with claim 8, wherein:

the machine has a front and a rear end; and a polishing unit is disposed at the rear end and behind the pair of driven counterrotating cylindrical brushes.

11. A floor cleaning machine in accordance with claim 1 further comprising:

a plurality of adjustment devices, each adjustment device adjusting an amount of engagement of a different sweeper with one of the pair of driven counterrotating cylindrical brushes.

12. A machine in accordance with claim 11 wherein:

the machine has a front and a rear end; and a polishing unit is disposed at the rear end and behind the pair of driven counterrotating cylindrical brushes.

13. A machine in accordance with claim 4 wherein:

the machine has a front and a rear end; and a polishing unit is disposed at the rear end and behind the pair of driven counterrotating cylindrical brushes.

* * * * *